US007522868B2

(12) United States Patent
Schultheis et al.

(10) Patent No.: US 7,522,868 B2
(45) Date of Patent: Apr. 21, 2009

(54) DEVELOPER UNIT HAVING A DEVELOPER TAPE FOR TONER TRANSFER

(75) Inventors: Bernd Schultheis, Schwabenheim (DE); Holger Köbrich, Flörsheim (DE); Dieter Jung, Daaden (DE)

(73) Assignee: Schott AG, Mainz (DE)

( * ) Notice: Subject to any disclaimer, the term of this patent is extended or adjusted under 35 U.S.C. 154(b) by 331 days.

(21) Appl. No.: 10/572,996

(22) PCT Filed: Nov. 17, 2004

(86) PCT No.: PCT/EP2004/013032

§ 371 (c)(1),
(2), (4) Date: Mar. 23, 2006

(87) PCT Pub. No.: WO2005/050330

PCT Pub. Date: Jun. 2, 2005

(65) Prior Publication Data

US 2006/0285886 A1 Dec. 21, 2006

(30) Foreign Application Priority Data

Nov. 20, 2003 (DE) ..... 103 54 347

(51) Int. Cl.
*G03G 15/08* (2006.01)

(52) U.S. Cl. ..... 399/288

(58) Field of Classification Search ..... 399/239, 399/265, 278, 280, 288
See application file for complete search history.

(56) References Cited

U.S. PATENT DOCUMENTS

| | | | | |
|---|---|---|---|---|
| 4,370,056 | A | 1/1983 | Hays | |
| 4,412,733 | A * | 11/1983 | Doutney | 399/269 |
| 4,505,573 | A | 3/1985 | Brewington et al. | |
| 4,618,241 | A * | 10/1986 | Hays et al. | 399/284 |
| 4,743,937 | A | 5/1988 | Martin | |
| 4,958,193 | A | 9/1990 | Nojima et al. | |
| 5,602,632 | A * | 2/1997 | Kuehnle | 399/265 |
| 6,088,559 | A | 7/2000 | Costanza et al. | |
| 6,115,575 | A | 9/2000 | Kinoshita et al. | |
| 6,185,394 | B1 | 2/2001 | Lee | |
| 6,324,366 | B1 * | 11/2001 | Funayama et al. | 399/159 |
| 6,424,813 | B1 | 7/2002 | Hatakeyama | |

FOREIGN PATENT DOCUMENTS

| | | | |
|---|---|---|---|
| EP | 1 213 621 | A1 | 6/2002 |
| JP | 03013974 | A * | 1/1991 |
| JP | 06222657 | | 8/1994 |
| JP | 06301279 | A * | 10/1994 |
| JP | 06308813 | A * | 11/1994 |
| JP | 07064445 | A * | 3/1995 |
| JP | 09034203 | | 2/1997 |
| JP | 10312113 | A * | 11/1998 |
| JP | 10326051 | | 12/1998 |

* cited by examiner

*Primary Examiner*—Robert Beatty
(74) *Attorney, Agent, or Firm*—Pauley Petersen & Erickson

(57) ABSTRACT

A developer unit having a toner reservoir and a toner application device. The toner application device applies toner to a developer and the developer can be brought into a planar contact with an OPC (photo conductor drum). In order to improve the transfer of toner in the contact area between the OPC and the developer, the developer has a developer strip that is placed, in the contact area, in some areas of the surface of the OPC.

22 Claims, 2 Drawing Sheets

DEVELOPER UNIT HAVING A DEVELOPER TAPE FOR TONER TRANSFER

BACKGROUND OF THE INVENTION

1. Field of the Invention

This invention relates to a developer unit with a toner supply and a toner application device, wherein toner is applied to a developer device, and the toner can be brought into planar contact with an OPC.

2. Discussion of Related Art

Such a developer unit is known from European Patent Reference EP 1 213 621 A. In this case the developer unit has an exchangeable toner supply reservoir, from which toner is metered into a developer housing. The toner is applied by an application roller to the surface of the developer roller. The developer roller rolls off on an OPC, namely a photo-conductor drum, and in the process transfers the toner material. The OPC is known and has a latent charge image. The contact area between the developer roller and the OPC is embodied in the shape of a so-called "nip". Here, the rigid OPC surface penetrates into the elastically yielding surface of the developer roller. A planar contact area results accordingly, which has an extension in the circumferential surface of the OPC in a range of approximately 4 to 10 mm. The squeezed area between the OPC and the developer roller formed by this arrangement forms a non-defined deformation within which the circumferential velocity of the surface of the developer roller varies. In contrast, the surface velocity of the OPC is constant. Because of speed differences, this can lead to smearing of the toner in the contact area. Also, because of the centrifugal force prevailing in the squeezed area, toner particles with a large inherent weight, in particular, can be prematurely released from the developer roller prior to the actual contact area. This leads to scattering effects, which impair the sharpness of the printed image.

SUMMARY OF THE INVENTION

It is one object of this invention to provide a developer unit of the type mentioned above but which has improved toner transfer between the OPC and the developer device.

This object is achieved with a developer device that has a developer tape applied in the contact area to sections on the surface of the OPC.

With this arrangement, a nip of a large extension in the circumferential direction of the OPC can be created between the OPC and the developer device. Thus, even toner particles which require a long dwell time in the contact area can be dependably transferred to the OPC. This developer unit is particularly suited for a qualitatively high-level transfer of ceramic toner. As a result of the enlarged embodiment of the nip, in comparison with the prior art, it is also possible to clearly increase the circumferential speed of the OPC and the developer device, and thus the printing speed.

In accordance with one embodiment of this invention, the developer tape is embodied as an endlessly revolving tape, which revolves around at least two deflection rollers, and the contact area with the OPC is formed in the space between the deflection rollers. At least one of the deflection rollers is placed against the OPC with the developer tape placed between them. In the process, a predefined distance is created between the surfaces of the deflection rollers and of the OPC, within which the developer tape and the toner layer are arranged. Thus it is possible, if required, to set a defined contact pressure for the OPC.

However, it is also possible for the contact area to be arranged at a distance from both deflection rollers. In this case no, or only minimal, centrifugal forces act on the toner. The danger that toner particles are inadvertently released is thereby minimized. Also, with this embodiment an even contact pressure over the entire nip area is achieved.

For assisting the toner transfer, a charging device is assigned to the contact area, by which an electrical charge can be applied to the toner. The charging device can be formed by at least one corona device or at least one bias roller. The charging device is preferably arranged in the contact area between the contact points, at which the developer tape on the OPC and at a sufficient distance to these. It is thus possible to prevent scattering effects that are created outside of the contact area, which cause uncontrolled release of the toner.

In order to be able to always develop constant contact pressure forces between the developer tape and the OPC, in one embodiment a tape tensioning device is assigned to the developer tape. Thus it is also particularly conceivable for a control unit to be assigned to the tape tensioning device which adjusts the tape tensioning device as a function of a predeterminable set point. Thus the tape tension can be specifically set, for example as a printing parameter. It is thus possible to provide a match with the toner type employed and/or with the transferred image information.

To prevent toner residue on the developer tape following the transfer to the OPC, the developer tape has a surface roughness which is less in comparison with the toner element.

Thus, on its surface receiving the toner the developer tape has a surface roughness in the range of <0.7 times of the volume median diameter $d_{50\ vol}$ value of the toner used, in particular between 5 and 8 μm.

In another embodiment of this invention, a metering roller rolls off the coated surface of the developer tape downstream of the application device and upstream of the contact area in the transport direction. Thus, the metering roller rests against one of the deflection rollers with the developer tape placed between them. A defined gap area is created between the metering roller and the deflection roller, in which the thickness of the toner layer on the developer tape can be exactly set. For an optimal coating of the developer tape, the toner application device is embodied as an application roller, which rolls off on one of the deflection rollers with the developer tape placed between them.

BRIEF DESCRIPTION OF THE DRAWINGS

This invention is explained in greater detail in view of an exemplary embodiment represented in the drawings, wherein.

DESCRIPTION OF PREFERRED EMBODIMENTS

Figure 1:
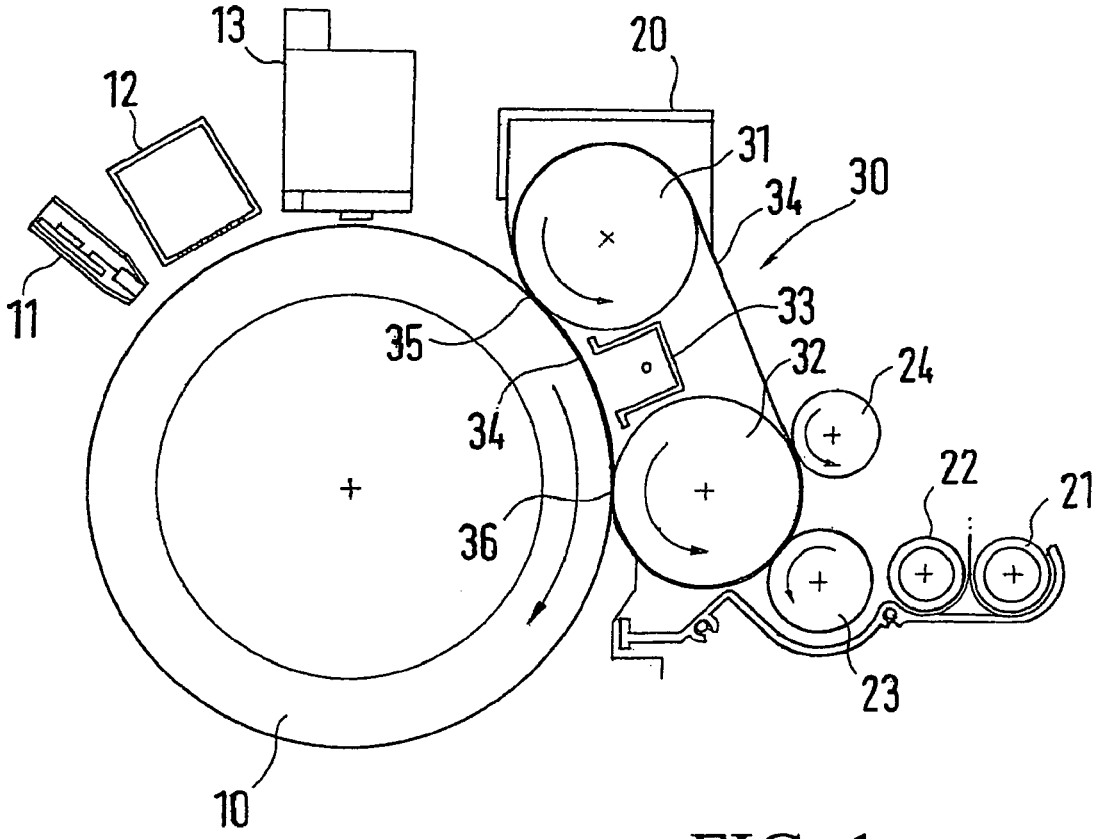
FIG. 1 shows a lateral representation in a sectional view, of a portion of the developer unit with an assigned OPC.

Sections of a developer unit with a developer housing 20 are represented in FIG. 1. A toner cartridge, not represented in the drawings, is assigned to the developer housing 20. Toner powder is metered from it into the area between two mixing worms 21, 22 in the developer housing. Following the mixing worms, the toner powder reaches a toner application device 23, which is designed as an application roller in the present case. The application roller 23 rolls off on the surface of a developer tape 34. The application roller 23 transfers the toner powder in the process. The developer tape 34 is guided around two deflection rollers 31, 32, which are axis-parallel with respect to each other. Viewed in the transport direction, a metering roller 24 is arranged downstream of the application roller 23. It is arranged in the area of the deflection roller 32 and ensures that the surface of the developer tape 34 is always supplied with toner of a constant thickness. The deflection roller 31 is used as a tensioning roller and can be displaced transversely to its axial direction. With this the developer tape 34 can be placed at a preset tape tension which, in one embodiment, can also be definitely set with the aid of electrostatic or electromagnetic actuation members.

At least one corona device or at least one bias roller is arranged as charging device 33 in the area between the two deflection rollers 31, 32.

As FIG. 1 shows, an OPC 10 which, is designed as a photo-drum, and is in contact with the developer tape 34. In this case the developer tape 34 is looped around a portion of the circumference of the surface of the OPC 10. The loop area forms a contact area, the so-called "nip". The nip here extends between the two lines of contact in which the deflection rollers 31, 32 rest against the OPC 10. The charging device 33 is arranged between these lines of contact and at a distance from them. In the contact area it aids the transfer of the toner to the OPC 10.

The OPC 10 is designed in a known manner. The corona charging device 12, which brings the OPC to a charge level, is assigned to it. A latent charge image is generated by an LED writing head 13. Viewed in the direction of rotation, a cancellation lamp 11 is arranged upstream of the corona charging device. It completely discharges the OPC.

For performing a printing process, first a latent charge image is generated on the OPC 10. During a rotation of the OPC 10, it is conducted to the developer unit. The deflection rollers 31, 32 are also simultaneously rotated and the developer tape 34 is evenly coated with toner via the application roller 23. As soon as the latent charge image reaches the contact area, the toner is transferred from the developer tape 34 to the OPC 10. Initially this occurs merely as a result of the charge difference between the OPC and the toner particles. The transfer is then actively assisted in the area of the charging device 33.

To prevent scattering effects, the charge control can also be laid out so that toner transfer takes place only in the area of the charging device 33.

At least one bias roller can be used as the charging device in place of the corona device shown in FIG. 1. It rolls off the developer tape 34 on the side facing away from the OPC. During this, it is possible to apply a pressure force which aids the toner transfer in addition to the applied charging voltage.

The charging device 33 can also be employed via a control device for compensating the aging of the OPC 10. Thus it is possible to readjust the charging voltage in intervals or continuously.

Figure 2:
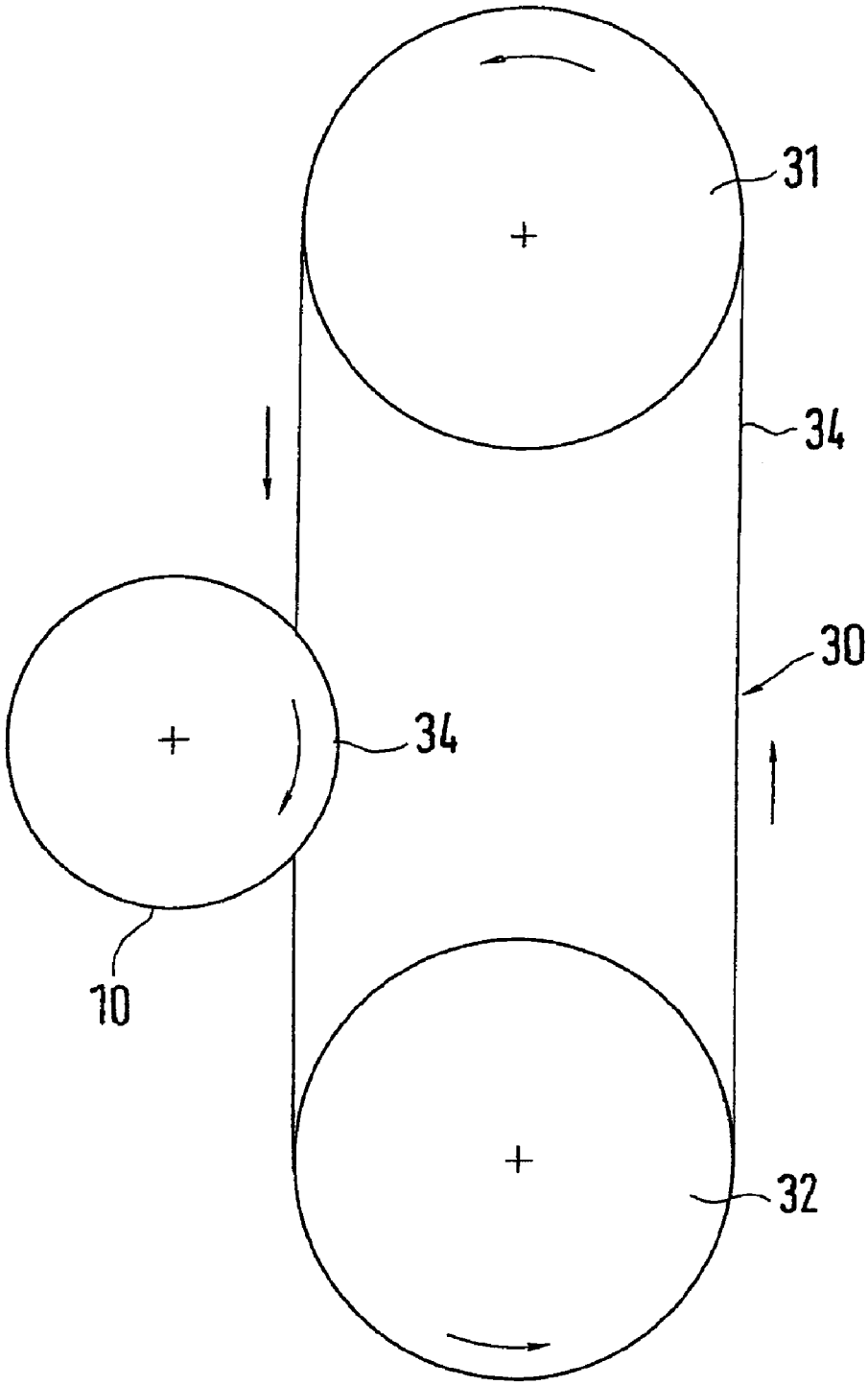
FIG. 2 shows a schematic representation, in a lateral view, a developer tape of a developer unit with an assigned OPC.

In one embodiment of this invention, an alternative to FIG. 1 is schematically represented in FIG. 2. In this case the OPC is arranged between the deflection rollers 31, 32 without contact with them. A nip is formed in which the same forces act between the developer tape 34 and the OPC 10 over the entire contact area. Also, no centrifugal forces, which could lead to scattering effects, act on the toner in the nip area.

The invention claimed is:

1. A developer unit with a toner supply and a toner application device, wherein toner is supplied to a developer device by the toner application device, and the developer device can be brought into planar contact with an OPC, the developer unit comprising:

the developer device having a developer tape applied in a contact area to sections on a surface of the OPC;

a tape tensioning device assigned to the developer tape; and a control unit assigned to the tape tensioning device which adjusts the tape tensioning device as a function of a predeterminable set point.

2. The developer unit in accordance with claim 1, wherein the developer tape is an endlessly revolving tape which revolves around at least two deflection rollers, and the contact area with the OPC is formed in a space between the deflection rollers.

3. The developer unit in accordance with claim 2, wherein at least one of the deflection rollers is placed against the OPC with the developer tape placed between them.

4. The developer unit in accordance with claim 2, wherein the contact area is arranged at a distance from both deflection rollers.

5. The developer unit in accordance with claim 4, wherein a charging arrangement is assigned to the contact area and an electrical charge is applied to the toner.

6. The developer unit in accordance with claim 5, wherein the charging device comprises at least one corona device.

7. The developer unit in accordance with claim 5, wherein the charging device is formed by at least one bias roller contacting the developer tape on a side facing away from the OPC.

8. The developer unit in accordance with claim 7, wherein on a surface receiving the toner, the developer tape has a surface roughness in a range of <0.7 times of the $d_{50vol}$ value of a toner used, between 5 and 8 μm.

9. The developer unit in accordance with claim 8, wherein a metering roller contacts the coated surface of the developer tape downstream of an application device and upstream of the contact area in a transport direction.

10. The developer unit in accordance with claim 9, wherein the metering roller rests against one of the deflection rollers with the developer tape placed between them.

11. The developer unit in accordance with claim 10, wherein the toner application device is an application roller in combination with one of the deflection rollers with the developer tape placed between them.

12. The developer unit in accordance with claim 1, wherein a charging arrangement is assigned to the contact area and an electrical charge is applied to the toner.

13. The developer unit in accordance with claim 12, wherein the charging device comprises at least one corona device.

14. The developer unit in accordance with claim 12, wherein the charging device is formed by at least one bias roller the developer tape on a side facing away from the OPC.

15. The developer unit in accordance with claim 2, wherein a metering roller contacts a coated surface of the developer tape downstream of an application device and upstream of the contact area in a transport direction.

16. The developer unit in accordance with claim 15, wherein the metering roller rests against one of the deflection rollers with the developer tape placed between them.

17. The developer unit in accordance with claim 2, wherein the toner application device is an application roller in combination with one of the deflection rollers with the developer tape placed between them.

18. A developer unit with a toner supply and a toner application device, wherein toner is supplied to a developer device by the toner application device, and the developer device can be brought into planar contact with an OPC, the developer unit comprising:

the developer device having a developer tape applied in a contact area to sections on a surface of the OPC, wherein on a surface receiving the toner, the developer tape has a surface roughness in a range of <0.7 times of the $d_{50vol}$ value of a toner used, between 5 and 8 μm.

19. The developer unit in accordance with claim 18, wherein a tape tensioning device is assigned to the developer tape.

20. The developer unit in accordance with claim 19, wherein a control unit is assigned to the tape tensioning device which adjusts the tape tensioning device as a function of a predeterminable set point.

21. The developer unit in accordance with claim 18, wherein the developer tape is an endlessly revolving tape which revolves around at least two deflection rollers, and the contact area with the OPC is formed in a space between the deflection rollers.

22. The developer unit in accordance with claim 21, wherein at least one of the deflection rollers is placed against the OPC with the developer tape placed between them.

* * * * *